United States Patent [19]

Hegenstaller

[11] Patent Number: 4,559,194

[45] Date of Patent: Dec. 17, 1985

[54] PALLET CLEAT AND METHOD OF MAKING SAME

[76] Inventor: Anton Hegenstaller, Muhlenstr. 9, 8891 Unterbernbach, Fed. Rep. of Germany

[21] Appl. No.: 620,056

[22] Filed: Jun. 13, 1984

Related U.S. Application Data

[63] Continuation-in-part of Ser. No. 461,604, Jan. 27, 1983.

[30] Foreign Application Priority Data

| | | | |
|---|---|---|---|
| Jan. 29, 1982 | [DE] | Fed. Rep. of Germany | 3203032 |
| Mar. 11, 1982 | [DE] | Fed. Rep. of Germany | 3208875 |
| Jun. 11, 1982 | [DE] | Fed. Rep. of Germany | 3222122 |
| Jun. 13, 1983 | [DE] | Fed. Rep. of Germany | 3321307 |

[51] Int. Cl.[4] ..... D04H 1/16

[52] U.S. Cl. ..... 264/113; 248/188.2; 248/346; 264/120; 264/122; 264/128; 264/257; 264/261; 264/320; 264/325

[58] Field of Search ..... 264/120, 122, 113, 128, 264/294, 109, 257, 261; 248/346, 188.2

[56] References Cited

U.S. PATENT DOCUMENTS

| | | | |
|---|---|---|---|
| 2,888,715 | 6/1959 | Frank | 264/120 |
| 3,104,085 | 9/1963 | Skildany | 108/51.1 |
| 3,342,146 | 9/1967 | Lessleim . | |
| 3,449,482 | 6/1969 | Mitchell et al. | 264/120 |
| 3,809,736 | 5/1974 | Munk | 264/120 |
| 3,933,968 | 1/1974 | Sorbier | 264/120 |
| 4,127,636 | 11/1978 | Flanders | 264/113 |
| 4,211,807 | 7/1980 | Yazawa et al. | 264/109 |
| 4,213,928 | 7/1980 | Casselbrant | 264/120 |
| 4,273,581 | 6/1981 | Inoue | 264/120 |
| 4,303,019 | 12/1981 | Haatago et al. | 108/51.1 |
| 4,385,564 | 5/1983 | Heggenstaller | 264/151 |

FOREIGN PATENT DOCUMENTS

| | | | |
|---|---|---|---|
| 2306507 | 9/1974 | Fed. Rep. of Germany | 264/109 |
| 2508493 | 9/1976 | Fed. Rep. of Germany . | |
| 3227074 | 9/1983 | Fed. Rep. of Germany . | |
| 2301441 | 9/1976 | France . | |
| 0086039 | 4/1936 | Sweden | 264/109 |
| 0101076 | 3/1941 | Sweden | 264/109 |

*Primary Examiner*—Jeffery Thurlow
*Assistant Examiner*—Patrick Dailey
*Attorney, Agent, or Firm*—Karl F. Ross; Herbert Dubno

[57] ABSTRACT

An elongated composite structural member such as a pallet cleat is made from elongated cellulosic particles and a binder by first providing a stiff and relatively incompressible board on a first wall confronting a second wall and defining therewith and with adjacent walls a compartment. A mass of the particles and binder are filled into the compartment between the walls and the first wall is displaced with the board toward the second wall and into the compartment into a predetermined intermediate position without substantial movement of the adjacent walls so as to subject the mass in the compartment between the first and second walls to a relatively low compression in a predetermined direction. At least one of the adjacent walls is then displaced transversely into the compartment without substantial movement of the first wall and the board from their intermediate position so as to subject the compressed mass in the compartment to a relatively low compression transverse to the direction. The first wall and the board are then moved toward the second wall into a terminal position to subject the mass in the compartment to a relatively high degree of compression in the direction without substantial movement of the side walls. Finally the mass is cured and hardened between the walls without substantial movement of same and so as to bond the mass to the board.

8 Claims, 9 Drawing Figures

PALLET CLEAT AND METHOD OF MAKING SAME

CROSS REFERENCE TO RELATED APPLICATION

This application is a continuation-in-part of copending patent application Ser. No. 461,604 filed Jan. 27, 1983.

FIELD OF THE INVENTION

The present invention relates to a pallet cleat or the like. More particularly this invention concerns the molding of such a structural member of cellulosic material.

BACKGROUND OF THE INVENTION

A standard freight pallet is a rigid load-supporting structure normally having a planar top formed by a single panel or a plurality of coplanar planks and feet formed as a plurality of parallel cleats secured underneath the top. Such a pallet is described in French Pat. No. 2,301,441.

In my copending patent application Ser. No. 219,859 filed Dec. 23, 1980 I disclose a method of making a pallet wherein a mass of coarse and fine particles and a binder is filled into an upwardly open elongated mold of generally regular cross section in such a manner that the fine particles are concentrated in the lower portion of the mass and the coarse particles are concentrated in the upper portion of the mass. The mass of particles is then compressed downward in the mold to a relatively great extent at several longitudinally spaced locations and to a lesser extent therebetween to form upwardly projecting bumps between the locations. The thus compressed mass is then cured into a stiffening rib or cleat. At least one board is secured to a plurality of such ribs or cleats arranged parallel to one another.

It is also known, as for example from German patent document No. 2,508,493 and from U.S. Pat. Nos. 3,104,085, 3,342,146, and 4,303,019, to make the entire pallet as a single integral molded element formed of cellulosic, that is plant-origin, particles and an appropriate thermosetting binder. Such pallets are normally relatively weak, being particular susceptible to damage from bending. It has been suggested in German patent document No. 3,035,701 to compress the structural members constituting the cleats more between the feet than at them to increase their strength and resistance to breaking in this region. Although an increase in strength is obtained in this manner the resultant pallet is still considerably weaker than a standard solid-oak pallet.

I describe in above-cited parent application Ser. No. 461,604 a method of making an elongated structural member from elongated cellulosic particles and a binder wherein a mass of the particles and binder is randomly filled, that is with the particles not extending parallel to one another although a stratified filling according to my earlier invention may be used, into a horizontally elongated compartment defined between a pair of elongated and horizontally confronting side walls having central portions, an elongated top wall, and an elongated bottom wall confronting the top wall and extending generally parallel to the top and side walls. The top and bottom walls are then displaced vertically toward each other into predetermined intermediate positions without substantial movement of the side walls so as to vertically compress the mass in the compartment. Thus the particles engaging the top and bottom walls are aligned generally therewith. At least the central portions of the side walls are then displaced horizontally toward each other between the top and bottom walls without substantial movement of the top and bottom walls from their intermediate positions so as to horizontally compress the vertically compressed mass in the compartment, Finally the top and bottom walls are displaced vertically toward each other into terminal positions to further vertically compress the mass in the compartment without substantial movement of the side walls. The mass is then cured and hardened between the walls without substantial movement of same.

Such pallets are inexpensive to manufacture and are relatively durable. Nonetheless they are often inadequately strong, in particular when bent or unevenly loaded, and are subject to rapid disintegration in particular when they must stand on a wet surface or are slid about a great deal on a rough surface.

OBJECTS OF THE INVENTION

It is therefore an object of the present invention to provide an improved method of making a so-called composition pallet.

Another object is the provision of such a method of making a so-called composition pallet which produces a pallet cleat or similar structural member which overcomes the above-given disadvantages, that is which is strong and durable while remaining cheap to manufacture.

SUMMARY OF THE INVENTION

An elongated elongated structural member such as a pallet cleat is made according to the broadest terms of this invention principally from elongated cellulosic particles and a binder by first providing a stiff and relatively incompressible board on a first wall confronting a second wall and defining therewith and with adjacent walls a compartment. A mass of the particles and binder are filled into the compartment between the walls and the first wall is displaced with the board toward the second wall and into the compartment into a predetermined intermediate position without substantial movement of the adjacent walls so as to subject the mass in the compartment between the first and second walls to a relatively low compression in a predetermined direction. At least one of the adjacent walls is then displaced into the compartment without substantial movement of the first wall and the board from their intermediate position so as to subject the compressed mass in the compartment to a relatively low compression transverse to the direction. The first wall and the board are then moved toward the second wall into a terminal position to subject the mass in the compartment to a relatively high degree of compression in the direction without substantial movement of the side walls. Finally the mass is cured and hardened between the walls without substantial movement of same and so as to bond the mass to the board.

The board according to this invention can be a simple wooden plank of relatively low-grade lumber. The inner face of the board is either left rough or is otherwise made irregular so the bond at the interface between the board and the core of cellulosic material is very strong. Under any circumstances a board is chosen which is not damaged by the pressures being employed, so that the board can easily transmit these pressures to the core which must be compressed to attain the desired strength.

Using a board as pressing member in the direction of most compression of the material furthermore ensures an extremely strong connection between the board and the core. The strength of the connection is many times greater than could be obtained by simply nailing or stapling the board to the cured and hard cleat, and is done at lower cost. In fact the method according to this invention represents a substantial simplification in procedures, as the material being pressed cannot stick to the mold walls.

Finally the system of this invention greatly increases the strength of the finished cleat, as well as making its floor-engaging face much more resistant to moisture and abrasion than would be possible for the composition core. The resultant structural member can be used in other applications as a load-bearing beam and can be produced at a fraction the cost of a standard such item.

According to another feature of this invention another such board is provided on the second wall confronting the first-mentioned board in the direction and the mass is bonded to the other such board also. In addition according to this invention the maximum-compression direction is upright and the first wall is directed upward. Thus the first board is simply dropped into the open mold before the pressing operation starts.

In accordance with further features of this invention such boards are also provided on the central portions of the side walls of the compartments, whereby the mass is compressed between the side boards the mass is also bonded to them. Furthermore the boards can be laminated or formed of plywood. The bottom board can be rubbed on the side walls during compression to upwardly bow it.

DESCRIPTION OF THE DRAWING

The above and other features and advantages will become more readily apparent from the following, it being understood that any feature described with reference to only one embodiment of the invention can be used where possible with any other embodiment. In the accompanying drawing.

SPECIFIC DESCRIPTION

Figure 5:
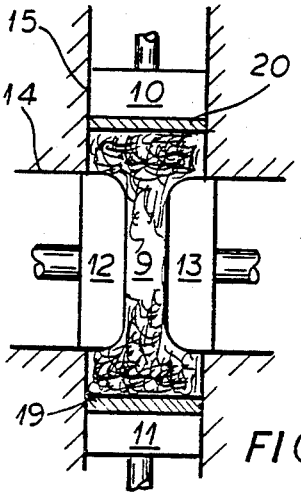
Figure 6:
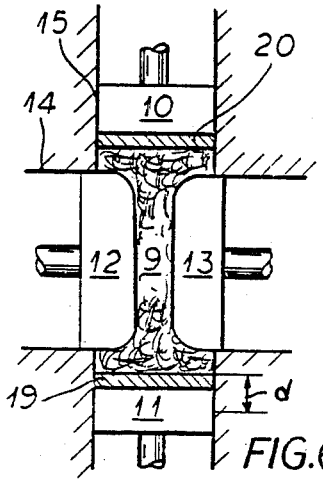
Figure 7:
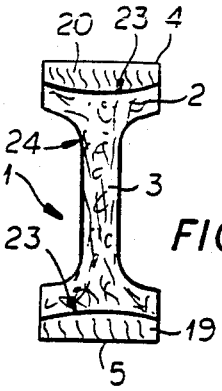
FIG. 7 is a vertical section through a structural element according to this invention.

FIG. 7 shows an I-section cleat or structural member 1 and FIGS. 1–6 show the mold for making it. This cleat 1 has a planar upper face 4 and lower face 5 parallel thereto. In addition it has a central web 3 and a pair of flanges 2 as is standard in such a structure. The web 3 is of substantially the same thickness as the flanges 2 measured of course in perpendicular directions transverse to the beam 1.

The mold for making this structure has a guide 15 receiving top and bottom pistons 10 and 11 and rounded side pistons 12 and 13 defining a molding compartment 9. The ends of the mold 10–15 are closed by stationary end walls.

Figure 1:
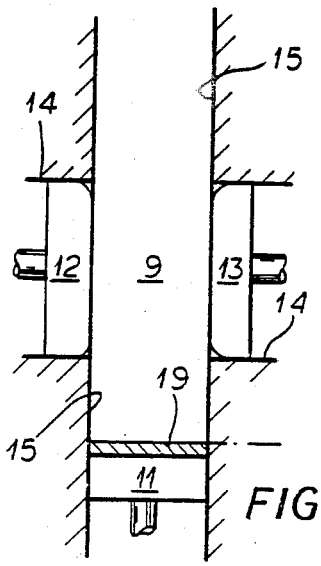
FIGS. 1 through 6 are vertical sections through the mold carrying out the method of this invention in successive stages in the manufacturing process.

This mold is operated in stages:

1. To start with the top piston 10 is moved wholly out of the way as shown in FIG. 1 and a board 19 of a width equal to the horizontal width of the guide 15 is placed atop the lower piston 11. The faces of the side pistons 12 and 13 are flush with the sides of the guide 15 and the piston 11 is in a respective lower position.

Figure 2:
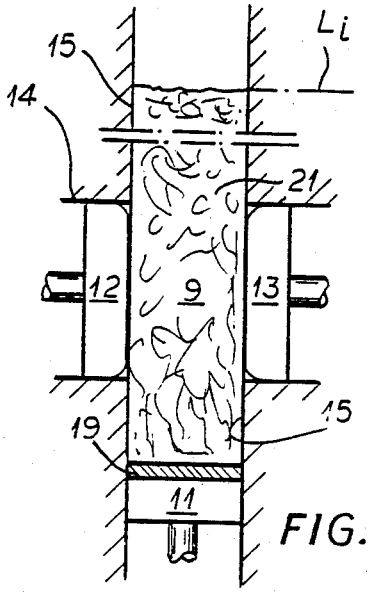

2. The chamber 9 is then filled with a mixture 21 of cellulosic particles and a binder as indicated in FIG. 2, filling it to a relatively high upper level $L_i$.

Figure 3:
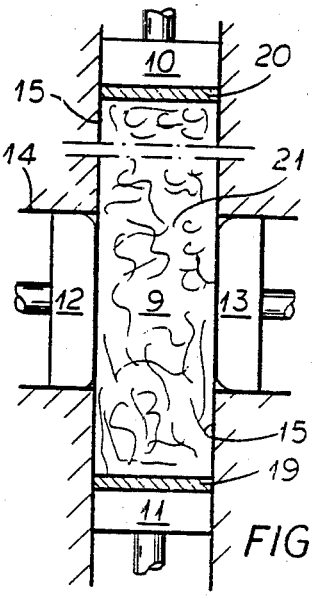

3. Another wood plank 20 identical to the plank or board 19 is laid atop the mass 21 and the piston 10 is fitted into the guide 15 and brought down atop the board 20 as shown in FIG. 3.

Figure 4:
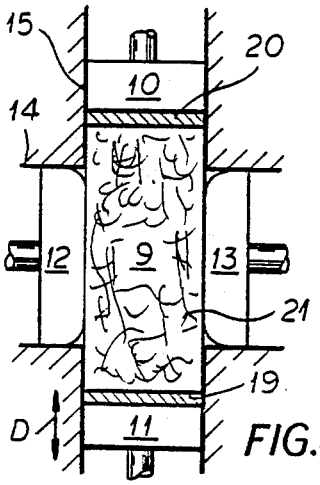

4. Then the top piston 10 moves down as seen in FIG. 4 to the intermediate level $L_i$ and the lower piston 11 moves up through a similar distance D. Meanwhile the pistons 12 and 13 have not moved. This action therefore subjects the mass 21 to an intermediate vertical compression.

5. The side pistons 12 and 13 then as shown in FIG. 5 move toward each other into the compartment 9 while the pressure in the cylinders for the pistons 10 and 11 is relieved to hold same stationary. This preforms the web 3 with an intermediate compression.

6. The top piston 10 is then moved down through a short distance d as shown in FIG. 6 while the pistons 12 and 13 are held stationary, compacting the mass 21 vertically with a relatively high compression into a rigid core 24.

7. The mold is meanwhile heated to activate and harden the binder. The boards 19 and 20 are therefore bonded to the mass 21.

With this system according to this invention the boards 19 and 20 either have convex inner surfaces 23 as shown in FIG. 7, or they are made to be such a tight fit in the guide 15 that they are bowed somewhat or compressed somewhat more at the edges than centrally, giving the illustrated shape.

The bond between the boards 19 and 20, which may be facilitated by applying a layer of a heat-activatable adhesive to the surfaces 23 is also facilitated by the nonplanar shape of the inner face of the boards 19 and 20. To this end these boards 19 and 20 may have differently textured inner faces, such as ridged or bumpy. In any case since these boards 19 and 20 are themselves used as the pressing elements, the connection between them and the core 24 will be virtually integral and unitary. The connection will be across the entire interface, so that separation is impossible here.

The use of such boards on the surface has many advantages. First of all at low cost it is possible to greatly increase the resistance to abrasion of the cleat. Furthermore the overall strength of the cleat is increased considerably, once again at low cost. The problems of demolding the cleat are also substantially eased, as any tendency of the material to bond to the top and bottom pistons 10 and 11, which exert the greatest compressive force on the workpiece, is completely eliminated, making the use of mold-release agents on these elements unnecessary.

Figure 8:
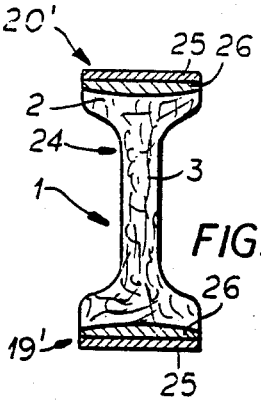
FIGS. 8 and 9 are sections like FIG. 7 through further cleats in accordance with this invention.

It is also possible, as shown in FIG. 8, to use boards 19' and 20' that are each formed of two layers 25 and 26. The outer layer 25 may be some material that is particularly resistant to abrasion while the inner layer 26 is selected for strength and bondability to both the outer layer 25 and the core 24.

Figure 9:
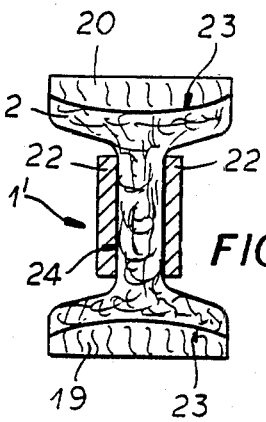

In FIG. 9 a beam 1' is shown that is substantially identical to that of FIG. 7 except that wooden boards 22 are bonded to the lateral faces of its web 3. This is done by loosely attaching them to the pistons 12 and 13, which can be formed with complementary recesses so the boards 22 are recessed in the faces of the web 3.

I claim:

1. A method of making an elongated structural member, the method comprising the steps of sequentially:

(a) providing a stiff and relatively incompressible board on a first wall confronting a second wall and defining therewith and with adjacent side walls a compartment;

(b) filling a mass of cellulosic particles and binder into the compartment between the walls;

(c) displacing the first wall with the board toward the second wall and into the compartment into a predetermined intermediate position without substantial movement of the adjacent walls and thereby subjecting the mass in the compartment between the first and second walls to a relatively low compression in a predetermined direction;

(d) displacing at least one of the adjacent walls into the compartment without substantial movement of the first wall and the board from their intermediate position and thereby subjecting the compressed mass in the compartment to a relatively low compression transverse to the direction;

(e) displacing the first wall and the board toward the second wall into a terminal position to subject the mass in the compartment to a relatively high degree of compression in the direction without substantial movement of the side walls; and (f) curing and hardening the mass between the walls without substantial movement of same and so as to bond the mass to the board.

2. The method defined in claim 1, further comprising the step of providing another such board on the second wall confronting the first-mentioned board in the direction; and bonding the mass to the other such board during step (e).

3. The method defined in claim 1 wherein the direction is upright and the first wall is directed upward.

4. A method of making an elongated structural member, the method comprising the steps of sequentially:

(a) providing a stiff and relatively incompressible board on the elongated bottom wall of a horizontally elongated compartment defined between a pair of elongated and horizontally confronting side walls having central portions, an upwardly open top above the elongated bottom wall confronting the top wall and extending generally parallel to the top and side walls;

(b) filling a mass of cellulosic particles and binder into the compartment;

(c) displacing the top wall and the bottom wall with its board vertically toward one other into predetermined intermediate positions without substantial movement of the side walls and thereby vertically compressing the mass in the compartment between the board and the top wall;

(d) displacing at least the central portions of the side walls horizontally toward each other between the top wall and bottom board without substantial movement of the top wall and bottom board from their intermediate positions and thereby horizontally compressing the vertically compressed mass in the compartment between the bottom board and top wall;

(e) displacing the top wall and bottom board vertically toward each other into terminal positions to further vertically compress the mass in the compartment without substantial movement of the side walls; and (f) curing and hardening the mass between the walls without substantial movement of same and so as to bond the mass to the board.

5. The method defined in claim 4, further comprising the steps of:

providing such boards on the central portions of the side walls of the compartments, whereby the mass is compressed between the side boards; and bonding the mass to the side boards.

6. The method defined in claim 4 wherein the boards are laminated.

7. The method defined in claim 4, further comprising the step of:

rubbing the bottom board on the side walls during steps (c) and (e) and thereby upwardly bowing the bottom board.

8. A method of making an elongated structural member, the method comprising the steps of sequentially:

(a) providing a stiff and relatively incompressible board on top of the elongated bottom wall of a horizontally elongated compartment defined between a pair of elongated and horizontally confronting side walls having central portions and flanking the bottom wall and an open and elongated top above the bottom wall;

(b) filling a mass of cellulosic particles and binder into the elongated compartment on top of the board;

(c) closing the top of the compartment with another such board;

(d) displacing the top board and the bottom wall with its board vertically toward each other into predetermined intermediate positions without substantial movement of the side walls and thereby vertically compressing the mass in the compartment;

(e) displacing at least the central portions of the side walls horizontally toward each other between the top and bottom boards without substantial movement of the same from their intermediate positions and thereby horizontally compressing the vertically compressed mass in the compartment;

(f) displacing the top and bottom boards vertically toward each other into terminal positions to further vertically compress the mass in the compartment without substantial movement of the side walls; and (g) curing and hardening the mass between the walls without substantial movement of same while bonding the mass to the boards.

* * * * *